United States Patent [19]

Hartkopf et al.

[11] 4,038,861

[45] Aug. 2, 1977

[54] WORKPIECE FEED CHANNEL

[75] Inventors: Heinz Hartkopf, Solingen; Horst Schneider, Witzhelden, both of Germany

[73] Assignee: Th. Kieserling & Albrecht, Solingen, Germany

[21] Appl. No.: 620,773

[22] Filed: Oct. 8, 1975

[30] Foreign Application Priority Data

Oct. 16, 1974 Germany ..... 2449241

[51] Int. Cl.[2] ..... B23B 25/00; B21D 37/10

[52] U.S. Cl. ..... 72/416; 82/38 R; 214/1 B

[58] Field of Search ..... 82/2.5, 2.7, 38; 72/416; 140/147; 214/1 B, 1.1, 1.3

[56] References Cited

U.S. PATENT DOCUMENTS

| | | | |
|---|---|---|---|
| 3,147,653 | 9/1964 | Jones, Jr. | 82/2.7 |
| 3,447,694 | 6/1969 | Hartle | 82/2.7 |
| 3,535,963 | 10/1970 | Dietl | 82/38 R |

*Primary Examiner*—Harrison L. Hinson

*Attorney, Agent, or Firm*—Edward E. Sachs

[57] ABSTRACT

A feed channel for elongated workpieces includes a plurality of adjustable workpiece receiving openings. Each opening is formed by a plurality of profiled segments including at least one movable segment. The movable segments are movable to expose the openings for lateral introduction thereinto of an elongated workpiece. The movable segments are then moved to reduce the size of the openings and engage the workpiece for at least partially straightening same. The movable segments are then moved to increase the size of the openings for providing longitudinal and rotational movement of the workpiece relative to the openings.

13 Claims, 5 Drawing Figures

FIG. 3
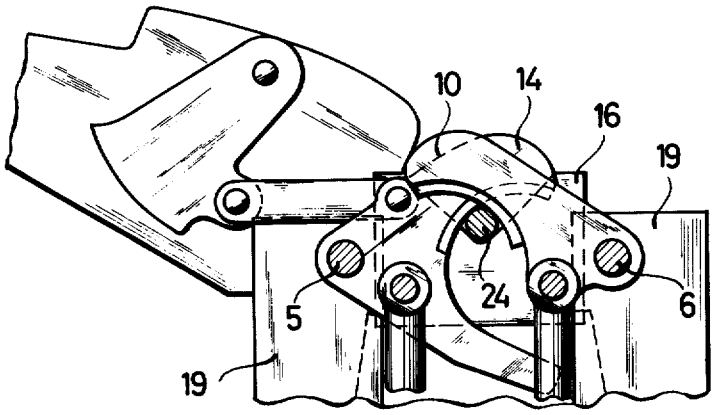
FIG. 4
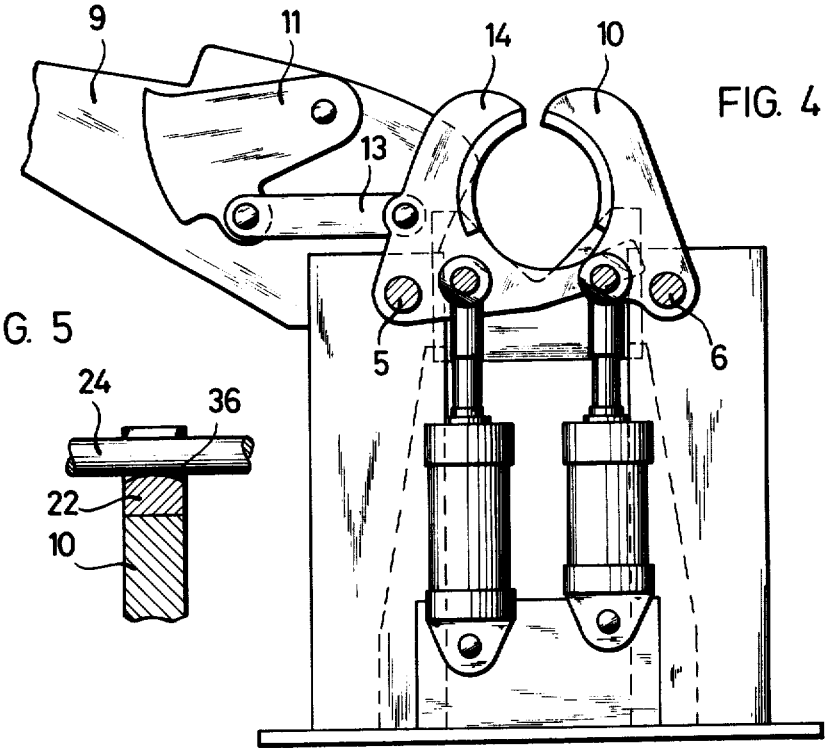
FIG. 5

WORKPIECE FEED CHANNEL

The invention relates generally to workpiece feed channels and, more particularly, to enclosed feed channels for feeding elongated rigid workpieces. The feed channel is particularly applicable for feeding elongated workpieces having a generally circular cross-sectional shape, such as wire, rod and pipe. The feed channel is particularly useful for feeding such workpieces in combination with peeling and straightening machines, and the workpieces rotate rapidly as they move longitudinally through the channel.

In modern straightening machines having two or more rolls, the end of the workpiece being straightened undergoes helical movements. The rotary component of these helical movements causes the ends of the workpiece held in the inlet and outlet channels of the straightening machine to carry out heavy flailing movements. The resulting noise and wear, both in the workpiece being worked upon or straightened, and in the inlet and outlet channels, restricts the output of straightening machines. This is particularly inconvenient when straightening and peeling machines are arranged one after the other because the output of the peeling machine cannot be greater than that of the straightening machine. The inadequacies of existing feed channels become apparent as soon as the workpiece drops into them. For instance, when a heavy workpiece drops into the channel, it produces an unpleasantly loud noise. The larger the cross section of the channel, the farther the workpiece falls, and the louder the noise. From this point of view, it would be better to have a channel with a small cross section. However, it is also possible for the workpiece to be so curved longitudinally that all of it cannot drop into the channel, and from this point of view it would therefore be better to have a channel of larger cross section. Again, from the point of view of feeding the workpiece through the channel, it would be better to have a channel with a small cross section, thus minimizing the flailing of the workpiece therein and the above mentioned disadvantages associated therewith, i.e. restriction of output, noise and increased wear. For high output, it would be better to have a channel adapted to the diameter of the workpiece.

In addition to the disadvantages mentioned above, namely that small workpieces in large channels carry out violent flailing movements, there is the problem that, in a channel designed for a specific range of diameters of products to be straightened, smaller workpieces, which have more room in the channel, also rotate faster than larger workpieces. The reason for this is that the straightening rolls in a two-roll straightener impart a specific peripheral velocity to the workpiece and this inevitably causes small diameter workpieces to rotate faster than those of larger diameter. For economic reasons, channels of the type outlined above are usually designed for a particular range of diameters, in order to avoid frequent channel changes.

An aspect of the present invention resides in providing a feed channel for elongated workpieces of varying diameters. The channel has a plurality of longitudinally spaced-apart adjustable workpiece receiving openings with each opening being formed by a pluraliy of profiled segments. At least one such segment defines a movable segment and is movable for exposing the openings to generally lateral introduction of an elongated workpiece thereinto. The plurality of profiled segments further includes a fixed segment constructed with a profile and arranged to receive and support the workpiece to effect that the lateral position of the axis of elongation of the workpiece in the feed channel is substantially the same for each workpiece. The said plurality of segments for each opening are longitudinally spaced apart from one another along said channel and the movable segments are movable to a position closing the openings so that the workpiece is completely surrounded by the segments.

A further aspect of the present invention resides in providing an apparatus of the type delineated in the preceding paragraph in which the profile of the fixed segment is substantially V-shaped to effect the positioning therein of small diameter workpieces at a relatively lower elevation than comparatively larger diameter workpieces.

Channels are known which are divided into two or more segments in profile, one or more of which is pivotable or displaceable, so that the channel may be opened for the purpose of picking up and putting down the workpiece to be transported.

It is therefore a primary object of the invention to provide a workpiece feed channel of the type outlined above which will be suitable for transporting workpieces of a large range of diameters.

It is a further object of the invention to provide such a feed channel which makes high speed straightening possible.

It is another object of the invention to provide such a feed channel which improves the quality of the straightening process.

It is an additional object of the invention to provide such a feed channel which at least partially straightens longitudinally curved elongated workpieces when they are introduced into the channel.

It is also an object of the invention to provide such a channel having adjustable workpiece receiving openings.

An aspect of the invention resides in a feed channel having a plurality of diaphragm-like adjustable openings arranged consecutively therealong. Each opening is formed by a plurality of profiled segments including at least one movable segment. The largest diameter of such a channel may therefore be designed according to the curvatures of the workpieces. When the movable profiled segments are pivoted in one direction the size of the openings is enlarged, and when the movable segments are pivoted in the opposite direction, the size of the openings is reduced. Since the channel can alter the diameter of the openings through it somewhat like a diaphragm in a camera by moving the movable segments, workpieces of small diameter may also be processed at high feed velocities and high rotational velocities. Furthermore, workpieces having a considerable degree of curvature may be pre-straightened while they are still stationary. This is achieved by moving the movable channel segments to initially reduce the channel or opening cross section by an amount greater than that required to feed the workpiece, after which the segments ae moved back to provide the correct cross section to feed the workpiece. This pre-straightening not only reduces the friction arising when the rotating workpiece is passing through the channel, but also improves the straightening action of the machine itself.

In order to be able to reduce the cross section of the channel to less than the cross section of the workpiece, provision is made for profiled arcs to be arranged at longitudinally-spaced intervals along the length of the channel. This makes it possible to bend the workpiece beyond its ideal shape. The spacing of the arcs is governed by the diameter of the smallest workpiece to be transported in the channel.

The surfaces of the profiled segments facing the workpiece are lined with segmental arcs made of a different material, for example a synthetic material such as plastic or the like. In order to prevent the workpieces from being marked by the segments during straightening in the channel, provision is made, according to another characteristic of the invention, for the surfaces of the segments facing the workpiece to be rounded off cross-sectionally to match the general shape of the workpiece. The shape of the profiled segments may be other than that of an arc. A kink or generally V-shaped surface approximately in the middle of the segment could increase the number of sides and angles of the polygonal shape of the openings, making the angles between adjacent sides more obtuse.

In order to eliminate the blow of the workpiece falling into the channel a catcher projection extending outside the profile of the channel or openings when the latter are closed is formed integrally with the ends of the movable profiled segments facing the feed grid. The said projections blend into the arcs of the profiled segment sections facing the workpiece. The catcher projection is a constituent part of a device for lifting in the workpieces. When the channel is open, the workpiece rolls towards the said catcher projection, and slides or rolls slowly between it and a rounded incline on the feed grid into the lower profiled segment. This design is particularly recommended for the invention because the length of the catcher projection is not limited by the opposing profiled segments in view of the fact that only one profiled segment section is provided in any given length of the channel.

According to a simplified configuration of the invention, one profiled segment may be secured immovably to the channel stand. In this case, the diaphragm-like adjustable opening function is still retained even if the laminated profiled segment sections of a profiled segment are immovable. This immovable arrangement of the lower profiled segment also has the advantage that the bottom surfaces of workpieces of different diameters are held at the same height in the straightening machine.

For a better understanding of the present invention, together with other and further objects thereof, reference is had to the following description taken in connection with the accompanying drawings, and its scope will be pointed out in the appended claims.

In the drawing:

FIG. 3 is a partial view similar to FIG. 2 and showing the channel in the process of pre-straightening a workpiece;

FIG. 4 is a cross-sectional elevational view taken generally on line IV—IV of FIG. 1 and showing the channel at its largest possible diameter for transporting large diameter workpieces; and FIG. 5 is a cross-sectional elevational view of a profiled segment.

Figure 1:
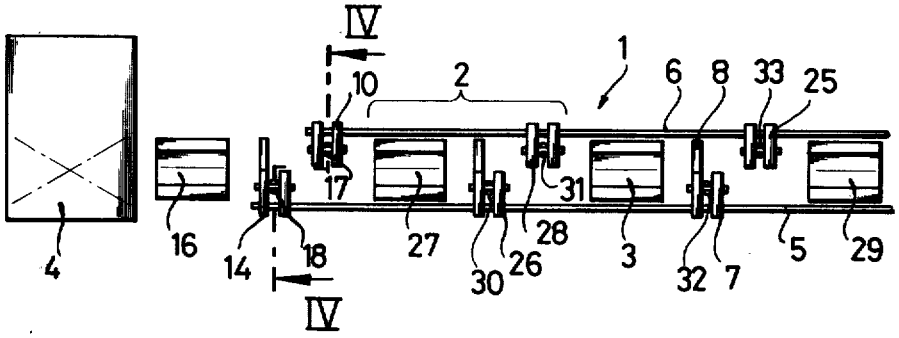
FIG. 1 is a plan view of a feed channel according to the invention, the channel to be used as an inlet feed channel on a two-roll straightening machine.

FIG. 1 shows channel 1 having a plurality of individual laminated profiled segment sections 3, 7, 10, 14, 16, 25, 26, 27, 28 and 29 shown in separated or paired arrangement, as preferred for straightening and guiding large diameter workpieces. A two-roll straightening machine 4 is attached to the channel 1, and moves elongated workpieces rotatably and longitudinally relative to the channel 1. A separated profiled segment section is regarded as a unit. Three profiled segment sections, for example segments 26, 27 and 28, constitute an adjustable opening 2. Profiled segment sections 7, 14 and 26 facing input grid 9 of FIG. 2 each has a catcher projection 8 as shown for the segment 14 in FIG. 2. Profiled segment sections arranged at the same angular position in relation to the workpiece, such as segments 10, 25 and 28, or 16, 27, 3 and 29, constitute a profiled segment. The profiled segment sections of each profiled segment are rigidly connected to each other. Sections 7, 14 and 26 are connected rigidly together by rotatable shaft 5, and sections 10, 25 and 28 are rigidly connected together by rotatable shaft 6. Sections 3, 16, 27 and 29 are rigidly connected to the foundation by support stand 20. The sections may be considered to be of prismatic shape with a rounded throat for the accommodation of the workpieces.

The cross section of the adjustable channel openings is formed by three laminated profiled segment sections. For example, one adjustable opening is defined by sections 10, 14 and 16 arranged in the form of a diaphragm, with opposite side segments 10 and 14 being pivotable toward and away from one another by shafts 5 and 6 mounted rotatably in channel stands 19. Arranged inside stands 19, at the moving profiled segments 10 and 14, and at intervals along the channel, are hydraulic cylinders 17, 18, 30, 31, 32 and 33, which insure simultaneous pivoting and uniform straightening of a workpiece by all profiled segment sections. During pivoting of the movable segments, the profiled segments are moved substantially radially of the longitudinal axis of the channel cross section and of elongated workpiece 24 located therein. All of the hydraulic cylinders are hinged to a support means secured to the foundation. The cross-sectional size of the channel openings is altered by the pivoting of shafts 5 and 6 by operation of the cylinders to move the movable segments. When the cross section is reduced, the opposing profiled segments move past one another like combs. The profiled segment sections are distributed individually at intervals along the length of the channel. Nowhere along the channel are there any profiled segments exactly opposite each other.

Arranged at the side of the channel is an inlet grid 9 having a stop step 34 against which a stock of workpieces to be straightened may rest. A lifter 11, a profiled-segment section 14, and a link 13 constitute a lifting device in the form of a mechanism having four hinges. The two stationary hinge points are pivot bearing 37 and shaft 5. Pivot bearing 37 is secured to inlet grid 9 which has a rounded inlet slope 12.

Figure 2:
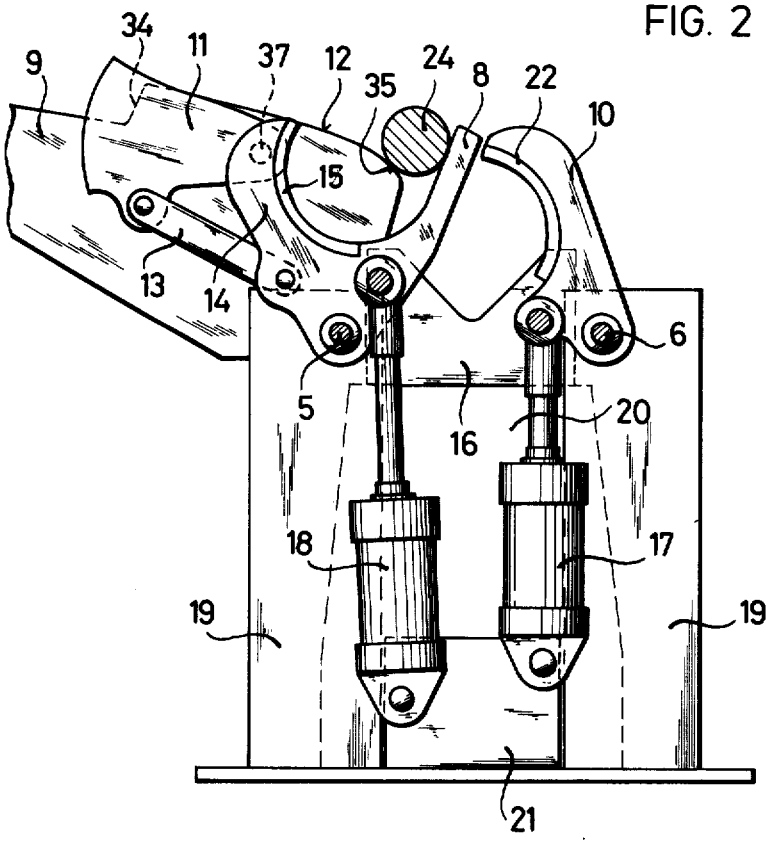
FIG. 2 is a cross-sectional elevational view of the channel accepting a workpiece.

A workpiece which is not shown rests against stop step 34 and is raised by lifter 11 onto inlet slope 12 from which the workpiece rolls slowly toward catcher projection 8. At this time, profiled segment section 14 is pivoted far out as shown in FIG. 2. The said section is then pivoted inwardly so that the workpiece rolls or slides smoothly between rounded edge 35 and projection 8 into immovable bottom profiled segment section 16. When profiled segment section 14 is pivoted to accept the workpiece, the channel opening is circumferentially closed and has the cross section shown in FIG.

4. The cross section of the channel is then automatically reduced, in accordance with characteristics of the workpiece, as shown in FIG. 3, in order to exert a straightening effect on the workpiece. In the alternative, where no straightening is required, the profiled segments are immediately pivoted inwardly to the extent required to feed the workpiece into the straightener.

Pivoting of the profiled segments is controlled by one or more potentiometers. Since the individual profiled segment sections are longitudinally spaced-apart, as seen along the length of the channel in FIG. 1, the workpiece may also be bent beyond its ideal shape. After the pre-straightening operation, the profiled segments are pivoted outwardly away from one another to produce a cross section which is suitable for feeding the workpiece longitudinally and rotatably, but is as small as possible, bearing in mind the residual curvature of the workpiece and the diameter thereof.

In the arrangement shown and described, there are a plurality of adjustable openings longitudinally spaced along the length of the channel 1 in FIG. 1. Each opening is defined by a plurality of segments 10, 14 and 16; 26, 27 and 28; and 3, 7 and 25. At least one segment for each opening is adjustably movable to expose the openings for lateral introduction of workpieces thereinto, and for varying the size of the openings. In the preferred arrangement, the bottom segments are fixed, and the opposite side segments are movable toward and away from one another. The segments cooperate to form a circumferentially closed opening which completely surrounds the workpiece as it travels longitudinally and rotatably through the channel.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

We claim:

1. A feed channel for elongated workpieces of varying diameters, said channel having a plurality of longitudinally spaced-apart adjustable workpiece receiving openings, each said opening being formed by a plurality of profiled segments, at least one segment for each said opening defining a movable segment and being movable for exposing said openings to generally lateral introduction of an elongated workpiece thereinto, a fixed segment constructed with a profile and arranged to receive and support the workpiece to effect that the lateral position of the axis of elongation of the workpiece in the feed channel is substantially the same for each workpiece, said plurality of segments for each said opening being longitudinally spaced-apart from one another along said channel, and said movable segments being movable to a position closing said openings so that the workpiece is completely surrounded by said segments.

2. The feed channel of claim 1 wherein corresponding profiled segments forming said openings are rigidly connected together.

3. The feed channel of claim 1 wherein the profile of said fixed segment is substantially V shaped to effect the positioning therein of small diameter workpieces at a relatively lower elevation than comparatively larger diameter workpieces.

4. The feed channel of claim 1 including a channel supporting stand, one profiled segment for each said opening being immovably mounted to said stand.

5. The feed channel of claim 1 wherein said plurality of segments at each said opening include a bottom segment, said movable segment having a workpiece catcher projection for lowering workpieces into said bottom segment when said movable segment is moved toward said bottom segment.

6. The feed channel of claim 1 wherein said segments have rounded surfaces forming the inner surface of said openings.

7. The feed channel of claim 1 wherein said segments for each said opening include a fixed bottom segment and a pair of opposite side segments mounted for movement toward and away from one another, and power means for moving said side segments.

8. The feed channel of claim 7 wherein one of said side segments has a workpiece catcher projection and said side segments are movable away from one another to a position wherein an elongated longitudinally curved workpiece fed laterally toward said channel is engaged by said projection, said side segments being movable toward one another for lowering movement of a workpiece engaging said projection onto said bottom segment.

9. The feed channel of claim 7 wherein said side segments are mounted on elongated rotatable shafts extending generally parallel to the longitudinal axis of said channel.

10. The feed channel of claim 1 wherein said plurality of segments at each said opening include a fixed bottom segment and a pair of movable opposite side segments.

11. The feed channel of claim 10 wherein said side segments are movable toward one another to a clamping position for clamping against an elongated longitudinally curved workpiece for at least partially straightening same, and said side segments being movable away from one another to a position surrounding the workpiece outwardly thereof for providing longitudinal and rotational movement of the workpiece relative to said openings.

12. The feed channel of claim 1 wherein said segments defining said openings include a plurality of longitudinally spaced fixed bottom segments, a plurality of movable first side segments longitudianlly spaced from one another and from said bottom segments, and a plurality of movable opposite side segments longitudinally spaced from one another and from said first side segments and said bottom segments, said side segments being movable toward and away from one another and toward and away from said bottom segments.

13. The feed channel of claim 12 including bottom connecting means for rigidly connecting said bottom segments, first side connecting means for rigidly connecting said first side segments, and second side connecting means for rigidly connecting said second side segments.

* * * * *